US005514004A

United States Patent [19]

Swanson

[11] Patent Number: 5,514,004

[45] Date of Patent: May 7, 1996

[54] ELECTRICAL CABLE APPARATUS

[76] Inventor: Carl E. Swanson, 707 E. South St., Corry, Pa. 16407

[21] Appl. No.: 341,025

[22] Filed: Nov. 17, 1994

[51] Int. Cl.[6] ..... H01R 13/62

[52] U.S. Cl. ..... 439/364

[58] Field of Search ..... 439/360, 361, 439/362, 364, 365, 366, 368, 369, 370; 24/129 A, 131 C

[56] References Cited

U.S. PATENT DOCUMENTS

| | | | |
|---|---|---|---|
| 2,266,560 | 12/1994 | Mansfield | 439/368 |
| 2,761,109 | 8/1956 | Hacker | 439/369 |
| 2,984,938 | 5/1961 | Crawford | 24/831 C |
| 3,781,761 | 12/1973 | Harwood | 439/369 |
| 3,922,055 | 11/1975 | McGregor | 439/369 |
| 4,206,961 | 6/1980 | Cifalde | 439/369 |
| 4,504,106 | 3/1985 | Fechter | 439/369 |

FOREIGN PATENT DOCUMENTS

| | | | |
|---|---|---|---|
| 0142383 | 7/1935 | Germany | 24/131 C |

*Primary Examiner*—Gary F. Paumen
*Assistant Examiner*—Hien D. Vu
*Attorney, Agent, or Firm*—Craig G. Cochenour

[57] ABSTRACT

An apparatus is disclosed for enabling the secure engagement of a first electrical cable having a male connector electrical contacting device to a second electrical cable having a female connector electrical contacting device. The apparatus includes a rigid body having a center region and a first and second end regions positioned at opposite ends of the center region. Each end region defines a S shaped structure having a single turn. Each end region S shaped structure has a middle section, proximal hook section and distal hook section in relationship to the center region. The middle section and proximal hook section of each end region are positioned with regard to the longitudinal axis of the center region in the same longitudinal plane. The distal hook sections of each end region are positioned in an outward extending direction in relationship to the middle and proximal hook sections and the center region in such a manner that the distal hook sections lie outside the longitudinal plane with regard to the longitudinal axis of the center region and the middle sections and proximal hook sections of the end regions.

5 Claims, 2 Drawing Sheets

ELECTRICAL CABLE APPARATUS

BACKGROUND OF THE INVENTION

1. Field of the Invention

This invention relates to an apparatus for enabling the secure engagement of a first electrical cable having a male connector electrical contacting device to a second electrical cable having a female connector electrical contacting device.

2. Brief Description of the Background Art

A secure engagement of electrical contacting devices of electrical cables is necessary for the successful employment of power equipment requiring electricity for operation. For example, an extension electrical cable is often required to be joined to the electrical cable of the power equipment to enable electrical power from an electrical power source to be supplied to the power equipment when it is desirable to employ the power equipment at a site that is remote from the electrical power source and at a distance that exceeds the length of the electrical cable of the power equipment. Often during the use of power equipment, the power equipment is operated and moved in such a manner that the extension electrical cable becomes unintentionally disengaged from the electrical cable of the power equipment. This unintentional disengagement is caused, such as for example, by vibration or stress applied relative to the male connector electrical contacting device (i.e. a plug) of the electrical cable of the power equipment and the female connector electrical contacting device (i.e. a socket) of the extension electrical cable. For example, the use of power equipment such as an outdoor electric hedge trimmer may require that a female connector electrical contacting device of an extension electrical cable be engaged to a male connector electrical contacting device of the electrical cable that is securely attached to the hedge trimmer. Successful operation of the hedge trimmer requires that the extension electrical cable be pulled over the rough and/or uneven surfaces of the ground or a foundation of a building causing accidental and unintentional disengagement of the female connector electrical contacting device of the extension electrical cable from the male connector electrical contacting device of the electrical cable of the hedge trimmer. It will be appreciated by those skilled in the art that the apparatus of the present invention may be used indoors as well as outdoors for ensuring the secure engagement of one electrical cable to another.

A number of patents disclose apparatuses for securing together electrical contacting devices of electrical cables. It will be understood by those skilled in the art that generally these background art devices attempt to securely fix together a plug (i.e. a male connector electrical contacting device) on one end of an extension electrical cable or an electrical cable of a power equipment and a socket (i.e. a female connector electrical contacting device) on one end of an extension electrical cable. However, none of the background art teach or suggest the apparatus of the present invention.

U.S. Pat. No. 3,922,055 (McGregor) discloses a device for securing a first electrical cable to a second electrical cable. This patent states that the device is an elongated rigid steel rod-like member having a mid-section region with first and second opposite end regions, wherein the end regions each define a coil-like structure with several turns for holding the electrical cables. However, as shown in the drawings of this patent, each electrical cable lies in a straight line when passing through the turns of the coils of the respective end regions, and therefore, the electrical cables tend to slip through the coils when pulled. This patent states that a manually operable clamp is pivotally secured to the mid-section region to detachably engage the engaged electrical connectors and for locking the same together.

U.S. Pat. No. 4,504,106 (Fechter) discloses an apparatus for securing together electrical cords comprising a hoop shaped body wherein electrical contacting devices are received, and two S shaped members connected to the body on opposite sides thereof so that the electrical contacting devices are between the members, and wherein each of the S shaped members have a center bar extending perpendicular to the longitudinal direction of the cords and two hook portions facing in opposite directions connected to the bar on opposite sides thereof, wherein each of the S shaped members are shaped to tightly receive a loop of one of the cords. This patent states that the center bar is connected to the hoop-shaped body by welding or soldering.

In spite of this background art, there remains a very real and substantial need for an apparatus for enabling the secure engagement of one end of a first electrical cable to an end of a second electrical cable for improving the ease of operation of equipment requiring electrical power.

SUMMARY OF THE INVENTION

The present invention has met the above-described need. The apparatus of the present invention provides an efficient and economical approach for substantially reducing and/or eliminating the undesired problems associated with accidental and/or unintentional disengagement of one electrical cable from another electrical cable.

The apparatus of this invention provides for the secure engagement of a first electrical cable having a male connector electrical contacting device to a second electrical cable having a female connector electrical contacting device. This apparatus includes a rigid body having a center region, a first end region and a second end region. The first end region and the second end region are at opposite ends of the center region of the rigid body. The first end region and the second end region each define a substantially S shaped structure. Each S shaped structure has a middle section and a proximal hook section and a distal hook section relative to the center region of the rigid body. The middle section of the S shaped structure is disposed between the proximal hook section and the distal hook section. The proximal hook section faces in an opposite direction relative to the distal hook section. Each of the S shaped structures define a single turn. The middle sections and the proximal hook sections of the S shaped structures are positioned with regard to the longitudinal axis of the center region of the rigid body in a same longitudinal plane as the center region of the rigid body. The distal hook sections of the S shaped structures are positioned in a substantially outward extending direction in relationship to the middle and proximal hook sections of the S shaped structures and the center region of the rigid body in such a manner that the distal hook sections of the S shaped structures lie substantially outside the longitudinal plane with regard to the longitudinal axis of the center region of the rigid body and the middle and proximal hook sections of the S shaped structures. The male connector electrical contacting device and the female connector electrical contacting device are disposed in juxtaposition to the center region of the rigid body and are capable of being intentionally manually engaged and disengaged adjacent to the center region of the rigid body. The first electrical cable is placed removably in the single turn of the S shaped structure of the first end region such that the first electrical cable is wound through the single turn of the S shaped structure of the first end region. The second electrical cable is placed removably in the single turn of the S shaped structure of the second end region such that the second electrical cable is wound through the single turn of the S shaped structure of the second end region.

In another embodiment of this invention, the apparatus further includes wherein the first electrical cable passes over the proximal hook section of the S shaped structure of the first end region, under the middle section of the S shaped structure of the first end region, and over the distal hook section of the S shaped structure of the first end region, and wherein the second electrical cable passes over the proximal hook section of the S shaped structure of the second end region, under the middle section of the S shaped structure of the second end region, and over the distal hook section of the S shaped structure of the second end region.

In another embodiment of this invention, the apparatus further includes wherein the distal hook section of the S shaped structure of the first end region of the rigid body and the distal hook section of the S shaped structure of the second end region of the rigid body are positioned in opposing outward extending directions in such a manner that the distal hook section of the S shaped structure of the first end region is positioned in a different longitudinal plane with regard to the longitudinal axis of the center region and as to the distal hook section of the S shaped structure of the second end region. The distal hook section of the S shaped structure of the second end region is positioned in a different longitudinal plane with regard to the longitudinal axis of the center region and as to the distal hook section of the S shaped structure of the first end region.

Another embodiment of the apparatus of this invention includes wherein a portion of the proximal hook sections of the S shaped structures are in a perpendicular arrangement with regard to the center region of the rigid body.

The apparatus of the present invention will be more fully understood from the following descriptions of the invention, and the drawings and the claims appended hereto.

DESCRIPTION OF THE PREFERRED EMBODIMENTS

The apparatus of the present invention provides for enabling the secure engagement of a first electrical cable having a male connector electrical contacting device to a second electrical cable having a female connector electrical contacting device.

Figure 1:
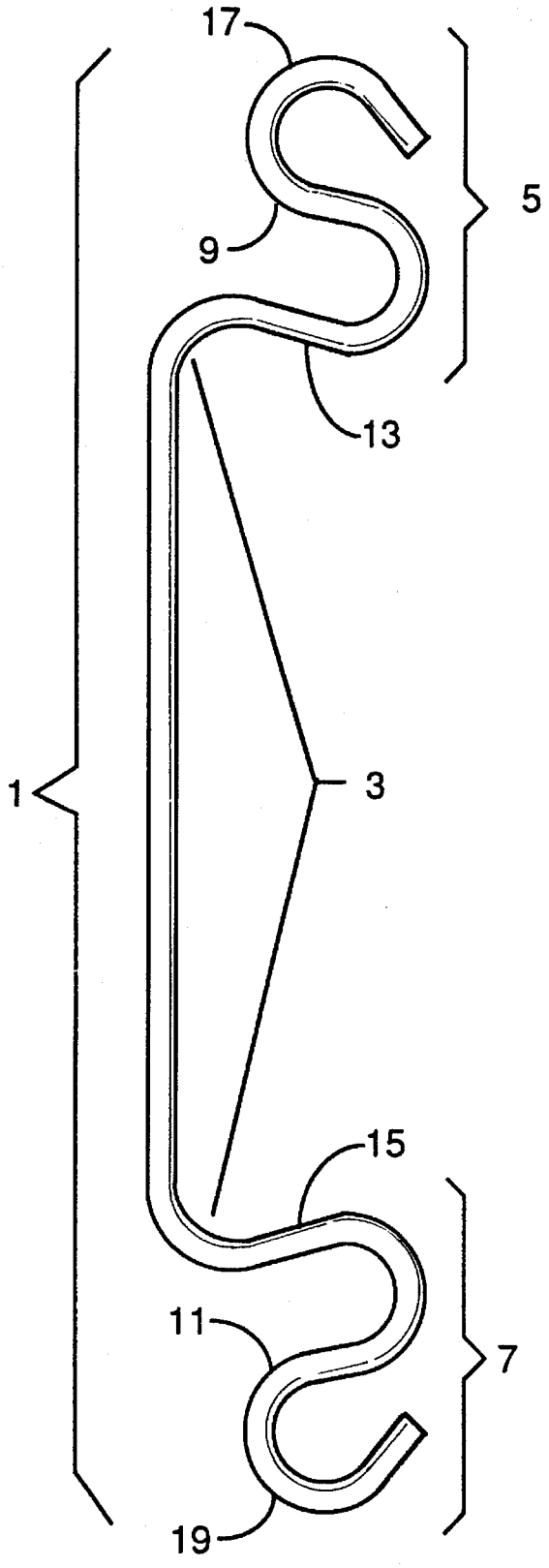
FIG. 1 is a left side plan view of a form of the apparatus of the present invention.
Figure 2:
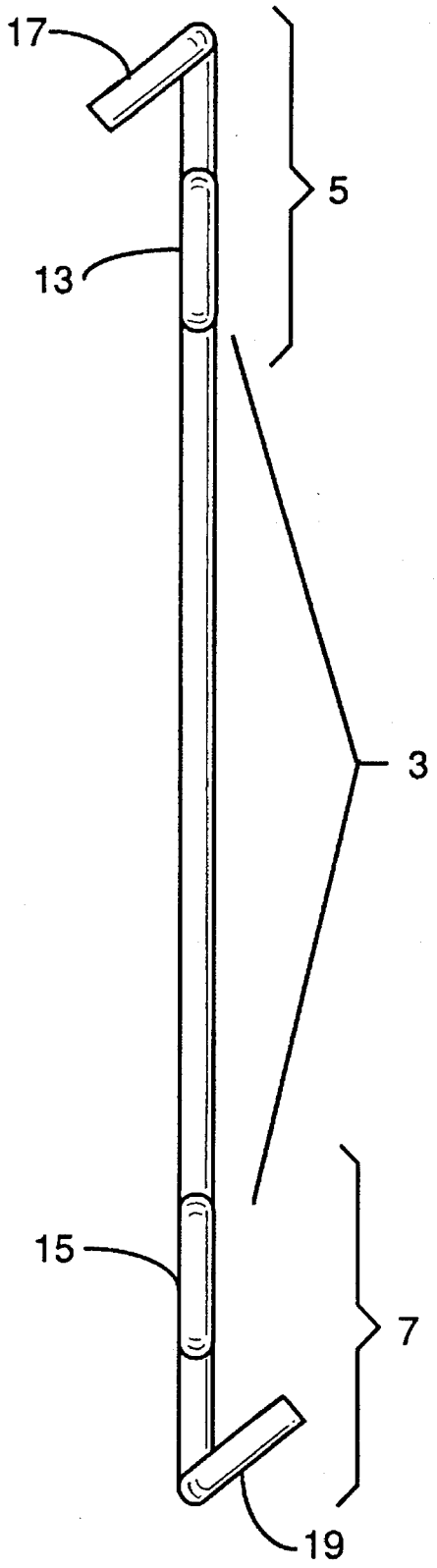
FIG. 2 is a top plan view of a form of the apparatus of the present invention.
Figure 3:
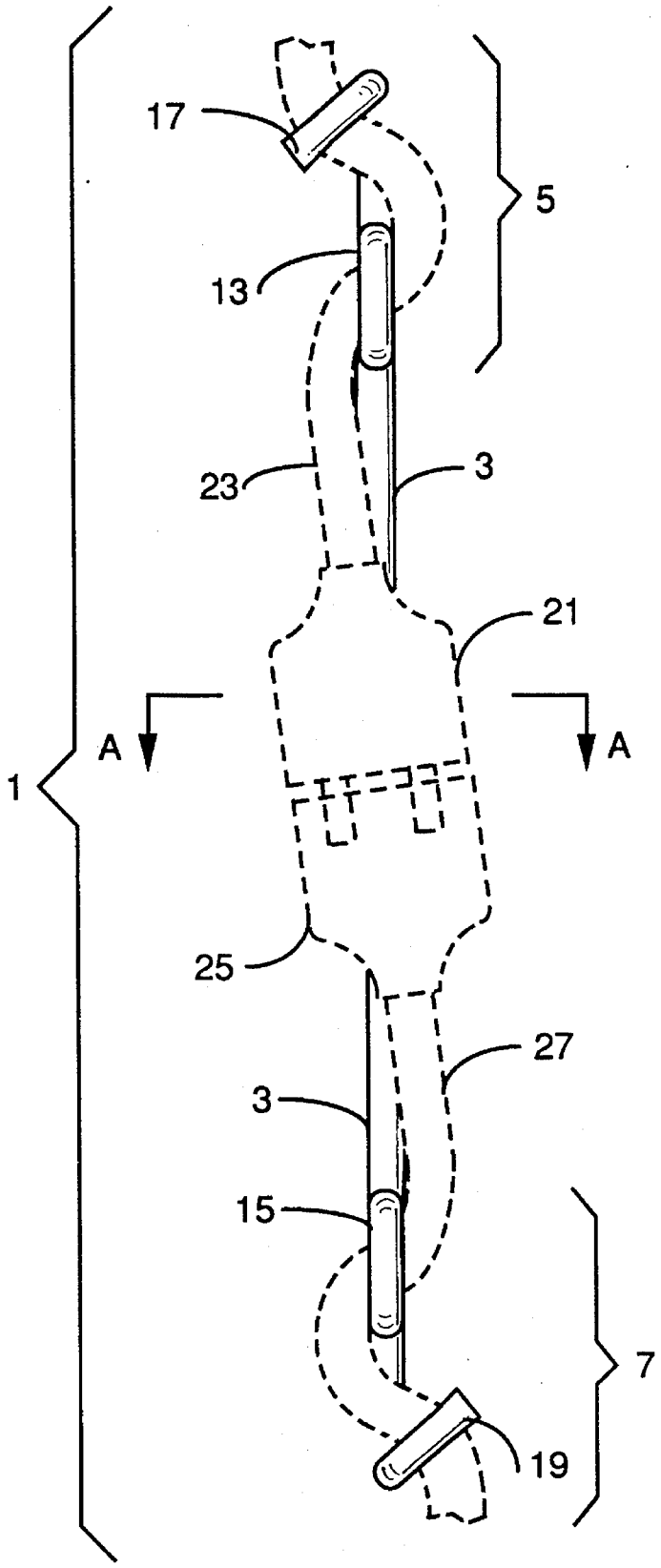
FIG. 3 is a top plan view of a form of the apparatus of the present invention with a portion of a first electrical cable and a portion of a second electrical cable shown in broken lines.

FIGS. 1–4 illustrate various views of a preferred form of the electrical cable apparatus of the present invention. In FIGS. 1–4, a rigid body 1 having a center region 3, a first end region 5 and a second end region 7 is provided. The first end region 5 and the second end region 7 are at opposite ends of the center region 3 of the rigid body 1. The first end region 5 and the second end region 7 each define a substantially S shaped structure. The S shaped structure of the first end region 5 has a middle section 9, and a proximal hook section 13 and a distal hook section 17 relative to the center region 3 of the rigid body 1. The S shaped structure of the second end region 7 has a middle section 11, and a proximal hook section 15 and a distal hook section 19 relative to the center region 3 of the rigid body 1. FIGS. 1–3 show that the middle sections 9 and 11, respectively, are disposed between the proximal hook sections 13 and 15, respectively, and the distal hook sections 17 and 19, respectively. FIG. 1 shows that the proximal hook sections 13 and 15, respectively, face in opposite direction relative to the distal hook sections 17 and 19, respectively. FIGS. 1–3 show that the S shaped structure of the first end region 5 defines a single turn and that the S shaped structure of the second end region 7 defines a single turn. FIGS. 2–3 show that the middle sections 9 and 11 and the proximal hook sections 13 and 15 are positioned with regard to the longitudinal axis of the center region 3 of rigid body 1 in the same longitudinal plane as the center region 3 of rigid body 1. FIGS. 2–3 show that distal hook sections 17 and 19 are positioned in an outward extending direction in relationship to (a) the middle sections 9 and 11, respectively, (b) the proximal hook sections 13 and 15, respectively, and (c) the center region 3 of rigid body 1 in such a manner that the distal hook sections 17 and 19 lie outside the longitudinal plane with regard to the longitudinal axis of (a) the middle sections 9 and 11, respectively, (b) the proximal hook sections 13 and 15, respectively, and (c) the center region 3.

FIG. 1 shows that a portion of proximal hook sections 13 and 15 lie or are positioned generally in a perpendicular arrangement in relationship to center region 3. It will be appreciated by those skilled in the art that the rigid body 1 of the apparatus of the present invention as described herein is generally a solid bar. It is preferable that the solid bar is round or circular, however it will be understood that the solid bar may be various shapes, for example oval or elliptical. It is also preferable that the solid bar be free of sharp or jagged edges and that each end of each distal hook sections 17 and 19 be smooth and may include for example a beveled end. Further it will be understood by those skilled in the art that the length and/or diameter of the rigid body 1 or solid bar of the present invention may be varied to accommodate various sizes, lengths and/or thicknesses of electrical cables. Further it will be appreciated that the apparatus of the present invention may be made of such as for example but not limited to a metal or aluminum, or a polymer(s) such as for example but not limited to poly(vinyl chloride) capable of being formed to establish a rigid body.

Figure 4:
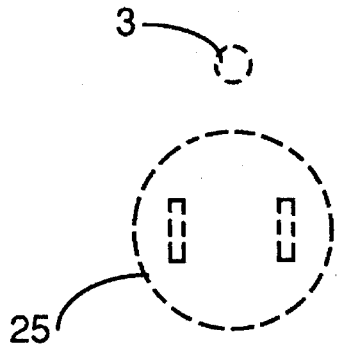
FIG. 4 is a cross-sectional view of the apparatus of the present invention of FIG. 3 taken along line A—A.

FIG. 3 shows a preferred embodiment of this invention wherein a male connector electrical contacting device 21 of a first electrical cable 23, shown in broken lines, and a female electrical contacting device 25 of a second electrical cable 27, also shown in broken lines, are (a) disposed in juxtaposition to the center region 3 of rigid body 1, and (b) capable of being intentionally manually engaged and disengaged adjacent to the center region 3 of rigid body 1. FIG. 3 shows that first electrical cable 23 is placed removably in the single turn of the S shaped structure of first end region 5 such that first electrical cable 23 is wound through the single turn of the S shaped structure of first end region 5. Further, FIG. 3 shows that second electrical cable 27 is placed removably in the single turn of the S shaped structure of second end region 7 such that second electrical cable 27 is wound through the single turn of the S shaped structure of second end region 7. In a more preferred embodiment of the present invention, FIG. 3 shows that the first electrical cable 23 passes (a) over proximal hook section 13, (b) under middle section 9, and (c) over distal hook section 17, and that the second electrical cable 27 passes (a) over proximal hook section 15, (b) under middle section 11, and (c) over distal hook section 19. In a most preferred embodiment of the present invention, the apparatus, as described herein, further includes wherein the male connector electrical contacting device 21 and first electrical cable 23 and the female connector electrical contacting device 25 and second electrical cable 27 traverse the center region 3 of rigid body 1 as illustrated in FIG. 3. FIG. 4 shows a view of the apparatus of the present invention taken along line A—A in FIG. 3. FIG. 4 shows rigid body 1 and an example of a face of a female connector electrical contacting device 25.

In another embodiment of the present invention, the apparatus as described herein and as shown in FIGS. 2–3 includes wherein distal hook section 17 of the S shaped structure of first end region 5 and distal hook section 19 of the S shaped structure of second end region 7 are positioned, relative to each other, in opposing outward directions in such a manner that distal hook section 17 of first end region 5 lies in a different longitudinal plane with regard to the longitudinal axis of center region 3 and distal hook section 19 of second end region 7. This embodiment of this invention further includes wherein distal hook section 19 of second end region 7 lies in a different longitudinal plane with regard to the longitudinal axis of center region 3 and distal hook section 17 of first end region 5 as shown in FIGS. 2–3.

It will be appreciated by those skilled in the art that the apparatus of the present invention advantageously provides for enabling the secure engagement of a first electrical cable to a second electrical cable. The apparatus of the present invention generally eliminates the undesired problem of accidental and/or unintentional disengagement of one electrical cable to another.

Whereas particular embodiments of the present invention have been described herein for purpose of illustration, it will be evident to those skilled in the art that numerous variations of the details of the present invention may be made without departing from the invention as defined in the appended claims.

What is claimed is:

1. A combination of a male connector electrical contacting device, a female connector electrical contacting device, and an apparatus for securing the engagement of a first electrical cable of said male connector electrical contacting device to a second electrical cable of said female connector electrical contacting device, said apparatus comprising:

a rigid body having a center region, a first end region and a second end region wherein said first region and said second end region are at opposite ends of said center region of said rigid body, said first end region and said second end region each defining a substantially S shaped structure having a middle section and a proximal hook section and a distal hook section relative to said center region of said rigid body, said middle section disposed between said proximal hook section and said distal hook section, and wherein said proximal hook section faces in an opposite direction relative to said distal hook section, and wherein said middle sections and said proximal hook sections of said S shaped structures are positioned, with regard to the longitudinal axis of said center region of said rigid body, in a same longitudinal plane as said center region of said rigid body, and wherein said distal hook sections of said S shaped structures are positioned in an outward extending direction in relationship to said middle and proximal hook sections of said S shaped structures and said center region of said rigid body in such a manner that said distal hook sections of said S shaped structures lie outside the longitudinal plane, and wherein said distal hook section of said S shaped structure of said first end region of said rigid body and said distal hook section of said S shaped structure of said second end region of said rigid body are positioned on opposite sides of said longitudinal plane, and wherein said male connector electrical contacting device and said female connector electrical contacting device are (a) disposed in juxtaposition to said center region of said rigid body, and (b) capable of being intentionally manually engaged and disengaged adjacent to said center region of said rigid body, and wherein said first electrical cable is placed removably in said S shaped structure of said first end region such that said first electrical cable is wound therethrough, and wherein said second electrical cable is placed removably in said S shaped structure of said second end region such that said second electrical cable is wound therethrough.

2. The combination of claim 1 wherein said first electrical cable passes (a) over said proximal hook section of said S shaped structure of said first end region, (b) under said middle section of said S shaped structure of said first end region and (c) over said distal hook section of said S shaped structure of said first end region, and wherein said second electrical cable passes (a) over said proximal hook section of said S shaped structure of said second end region, (b) under said middle section of said S shaped structure of said second end region and (c) over said distal hook section of said S shaped structure of said second end region.

3. The combination of claim 1 wherein a portion of said proximal hook sections of said S shaped structures are in a perpendicular arrangement with regard to said center region of said rigid body.

4. The combination of claim 1 wherein said male connector electrical contacting device and said female connector electrical contacting device traverse said center region of said rigid body.

5. The combination of claim 1 wherein said rigid body is generally a solid round bar.

* * * * *